US007212183B2

(12) United States Patent
Tobita

(10) Patent No.: US 7,212,183 B2
(45) Date of Patent: May 1, 2007

(54) LIQUID CRYSTAL DISPLAY APPARATUS HAVING PIXELS WITH LOW LEAKAGE CURRENT

(75) Inventor: Youichi Tobita, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 343 days.

(21) Appl. No.: 10/613,212

(22) Filed: Jul. 7, 2003

(65) Prior Publication Data

US 2004/0145551 A1 Jul. 29, 2004

(30) Foreign Application Priority Data

Jan. 29, 2003 (JP) ..... 2003-020498

(51) Int. Cl.
*G09G 3/36* (2006.01)

(52) U.S. Cl. ..... 345/93; 345/95

(58) Field of Classification Search ..... 345/87–88, 345/92–94, 96, 211
See application file for complete search history.

(56) References Cited

U.S. PATENT DOCUMENTS

| | | | | |
|---|---|---|---|---|
| 4,240,092 | A | 12/1980 | Kuo | |
| 4,591,848 | A * | 5/1986 | Morozumi et al. | 345/94 |
| 5,465,168 | A * | 11/1995 | Koden et al. | 345/96 |
| 5,506,598 | A * | 4/1996 | Shimada et al. | 345/92 |
| 6,313,818 | B1 | 11/2001 | Kondo et al. | |
| 2001/0022569 | A1 * | 9/2001 | Ohta et al. | 345/88 |
| 2002/0000576 | A1 | 1/2002 | Inukai | |
| 2004/0207615 | A1 * | 10/2004 | Yumoto | 345/211 |

FOREIGN PATENT DOCUMENTS

| | | |
|---|---|---|
| JP | 53-59384 | 5/1978 |
| JP | 60-103587 | 6/1985 |
| JP | 05-127619 | 5/1993 |
| JP | 08-204207 | 8/1996 |
| JP | 09-102614 | 4/1997 |
| TW | 375688 | 12/1999 |
| TW | 503565 | 9/2002 |

* cited by examiner

*Primary Examiner*—Amr A. Awad
*Assistant Examiner*—William L Boddie
(74) *Attorney, Agent, or Firm*—McDermott Will & Emery LLP

(57) ABSTRACT

A pixel has first to third N-type TFT elements serially connected between a data line and a pixel electrode node. Each gate of the first and second TFT elements is connected to a first gate line, while the gate of the third TFT element is connected to a second gate line. The first and second gate lines in a select state each set to a high voltage that can fully turn-on the first to third TFT elements. The first gate line in a non-select state is set to a low voltage that can fully turn-off the first and second TFT elements, while the second gate line in the non-select state is set to an intermediate voltage between the maximum and the minimum voltages being transmitted on the data line.

9 Claims, 7 Drawing Sheets

LIQUID CRYSTAL DISPLAY APPARATUS HAVING PIXELS WITH LOW LEAKAGE CURRENT

BACKGROUND OF THE INVENTION

1. Field of the Invention

The present invention relates to a liquid crystal display apparatus, and more specifically, to a liquid crystal display apparatus having a gate insulating field effect transistor in each pixel.

2. Description of the Background Art

As a display panel for a personal computer, a television receiver, a mobile phone, and a personal digital assistant, a liquid crystal display apparatus having liquid crystal elements as display pixels is used. Such a liquid crystal display apparatus is effective in reducing power consumption, size and weight, as compared to a conventional type.

The display luminance of a liquid crystal element changes in accordance with the level of voltage applied thereon (hereinafter a voltage applied to a liquid crystal element is also referred to as "a display voltage"). The display panel of a liquid crystal display apparatus is formed with pixels each having a liquid crystal element. Each pixel is applied a display voltage during a scanning period that is cyclically provided in accordance with a prescribed scanning cycle.

Each pixel in a non-scanning period retains the display voltage that is applied during a scanning period to provide the luminance corresponding to that retained voltage. For each pixel, a non-scanning period for retaining a data (a display voltage) is overwhelmingly longer than a scanning period for being written a data, i.e., being applied with a display voltage. For instance, for each pixel in a liquid crystal display apparatus with 200 scanning lines, a non-scanning period will be 200 times longer than a scanning period. Hence, the display voltage retentivity (data retentivity) in each pixel is significant, since lower display voltage retentivity requires a scan at higher frequencies, increasing the power consumption.

Generally, pixels are arranged on a glass substrate or a semiconductor substrate using a TFT (Thin Film Transistor) element or the like. Therefore, the display voltage retentivity above may be degraded when the level of retained display voltage decreases due to a leakage current occurring in the TFT element in a non-scanning period.

A configuration for suppressing such a leakage current during a non-scanning period is disclosed, for example, in Japanese Patent Laying-Open No. 5-127619, in which a plurality of TFT elements are connected in series in each pixel to divide a voltage applied on the TFT elements (source-drain voltage).

However, even with the pixel configuration shown in Japanese Patent Laying-Open No. 5-127619, it is difficult to suppress the leakage current at higher display voltages. Another known configuration involves controlling a gate voltage to forcibly reverse-bias a TFT element in a non-scanning period. In this case, since a voltage stress on a gate insulation film is large, the reliability of the gate insulation film becomes a problem.

SUMMARY OF THE INVENTION

The object of the present invention is to provide a liquid crystal display apparatus with pixels that can prevent breakdown of a gate insulation film while suppressing a leakage current for a field-effect transistor (a TFT element) in a non-scanning period (a data retention period).

A liquid crystal display apparatus comprises a plurality of pixels arranged in rows and columns, each for providing luminance corresponding to a display voltage; a plurality of first and second gate lines provided corresponding to the rows of pixels, respectively; a plurality of data lines provided corresponding to the columns of pixels, respectively; a gate drive circuit for driving each of the plurality of first and second gate lines to a voltage that is different between a select state in which corresponding one of the rows is selected for a scanning target in accordance with a prescribed scanning cycle and a non-select state except for the select state; and a source drive circuit for driving the plurality of data lines to the display voltage that corresponds to the pixels included in the row selected for the scanning target. The plurality of pixels each includes a liquid crystal element having a pixel electrode and a common electrode for providing luminance that corresponds to a voltage difference between the pixel electrode and the common electrode, a first field-effect transistor electrically connected between corresponding one of the data lines and a first node, and having its gate electrically connected to corresponding one of the first gate lines, and a second field-effect transistor electrically connected between the first node and the pixel electrode, and having its gate electrically connected to corresponding the second gate line. The gate drive circuit sets each voltage of the first and second gate lines in the select state to a first voltage that can turn-on each of the first and second field-effect transistors, while setting a voltage of the first gate line in the non-select state to a second voltage that can turn-off the first field-effect transistor as well as setting a voltage of the second gate line in the non-select state to a third voltage that is intermediate between a maximum value and a minimum value of the display voltage.

A liquid crystal display apparatus according to another configuration comprises a pixel for providing luminance corresponding to a display voltage; and a data line for transmitting the display voltage supplied to the pixel. The pixel includes a liquid crystal display element having a pixel electrode and a common electrode for providing luminance corresponding to a voltage difference between the pixel electrode and the common electrode, a first field-effect transistor electrically connected between the data line and a first node, and a second field-effect transistor electrically connected between the first node and the pixel electrode. The liquid crystal display apparatus further comprises a gate drive circuit for driving each gate voltage of the first and second field-effect transistors to a voltage that is different between a select state in which the pixel is selected for a scanning target in accordance with a prescribed scanning cycle and a non-select state except for the select state. The gate drive circuit in the select state sets each gate voltage to a first voltage that can turn-on each of the first and second field-effect transistors, while setting a gate voltage of the first field-effect transistor in the non-select state to a second voltage that can turn-off the first field-effect transistor as well as setting a voltage of the second field-effect transistor in the non-select state to a third voltage that is intermediate between a maximum value and a minimum value of the display voltage.

Accordingly, the primary advantage of the present invention is in suppression of an off-leakage current of a TFT element in a non-scanning period and reduction of voltage stress to a gate insulation film, which are achieved by serially connecting a plurality of TFT elements between a data line and a pixel electrode in each pixel, which can independently control the gate voltage.

As a result, display voltage retentivity in each pixel may be improved, and thus, a scanning cycle can be made longer to reduce the power consumption, variations in luminance can be suppressed to improve the display quality, and the operating reliability of the TFT elements can be improved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

In the following, embodiments of the present invention are described referring to the figures.

First Embodiment

First, an overall configuration of a liquid crystal display apparatus according to an embodiment of the present invention is described.

Figure 1:
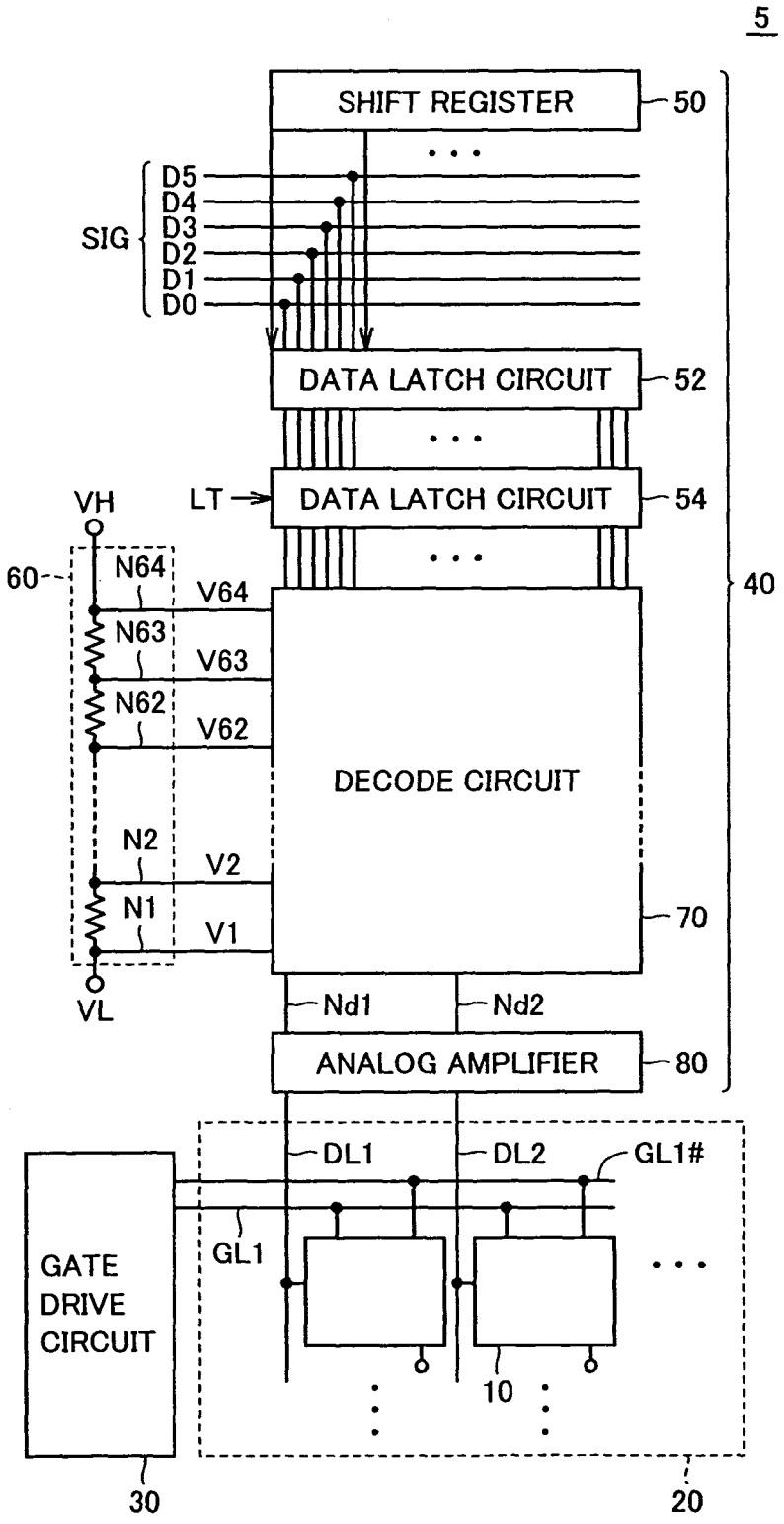
FIG. 1 is a block diagram showing an overall configuration of a liquid crystal display apparatus according to an embodiment of the present invention.

Referring to FIG. 1, a liquid crystal display apparatus 5 includes a liquid crystal array portion 20, a gate drive circuit 30, and a source drive circuit 40. Liquid crystal array portion 20 includes a plurality of pixels 10 arranged in rows and columns. Corresponding to each row of pixels (hereinafter also referred to as "a pixel row"), a first gate line GL and a second gate line GL# are arranged. Further, corresponding to each column of pixels (hereinafter also referred to as "a pixel column"), a data line DL is arranged. FIG. 1 representatively shows pixels in the first and second columns in the first row, and corresponding gate lines GL1, GL1# and data lines DL1, DL2.

Gate drive circuit 30 controls the voltage of gate lines GL, GL# so that gate lines GL, GL# are set to a select state in a scanning period and set to a non-select state in a non-scanning period, based on a prescribed scanning cycle. Gate lines GL, GL# are driven to a voltage that is different between a select state and non-select state. Further, gate lines GL and GL# may be independently controlled in each pixel row.

Source drive circuit 40 outputs a display voltage on data line DL that is set stepwise by a display signal SIG, which is an N-bit (N: a natural number) digital signal. FIG. 1 representatively shows a configuration where N=6, i.e., display signal SIG is formed with display signal bits D0–D5.

Based on the 6-bit display signal, luminance can be provided in $2^6$=64 steps of gray scale in each pixel 10. Further, when one color display unit is formed with each one of R (Red), G (Green) and B (Blue) pixels, approximately 260,000 colors can be displayed.

Source drive circuit 40 includes a shift register 50, data latch circuits 52, 54, a gray scale voltage generating circuit 60, a decode circuit 70, and an analog amplifier 80.

Display signal SIG is serially generated corresponding to display luminance for each pixel 10. Specifically, display signal bits D0–D5 in each timing indicate display luminance in one pixel 10 in liquid crystal array portion 20.

Shift register 50 instructs data latch circuit 52 to capture display signal bits D0–D5 at a timing synchronized with a prescribed cycle for switching the setting of display signal SIG. Data latch circuit 52 successively captures serially generated display signals SIG for one pixel row for retention.

At a timing when display signals SIG for one pixel row are captured in data latch circuit 52, the group of display signals latched by data latch circuit 52 is transmitted to data latch circuit 54 in response to the activation of a latch signal LT.

Gray scale voltage generating circuit 60 is formed with sixty-four numbers of voltage divider resistors that are serially connected between high voltage VH and low voltage VL, and generates 64 steps of gray scale voltages V1–V64 on gray scale voltage nodes N1–N64, respectively.

Decode circuit 70 decodes the display signal latched by data latch circuit 54, and selects from gray scale voltages V1–V64 based on the decode result. Decode circuit 70 outputs the selected gray scale voltage (one of V1–V64) on decode output node Nd as a display voltage. In the present embodiment, decode circuit 70 outputs display voltages for one row in parallel, based on the display signals latched by data latch circuit 54. Note that FIG. 1 representatively shows decode output nodes Nd1, Nd2 corresponding to data lines DL1, DL2 in the first and second columns.

Analog amplifier 80 outputs analog voltages on data lines DL1, DL2, respectively, that correspond to the display voltages provided on decode output nodes ND1, Nd2, . . . , respectively.

Though the configuration of liquid crystal display apparatus 5 in which gate drive circuit 30 and source drive circuit 40 are integrally formed with liquid crystal array portion 20 in FIG. 1, gate drive circuit 30 and source drive circuit 40 may be provided as external circuitry of liquid crystal array portion 20.

Technique of Suppressing Leakage Current in Pixel as Comparative Example

Next, a comparative example of a pixel configuration and a leakage current suppression is described for comparison with a pixel according to the present invention.

Figure 2:
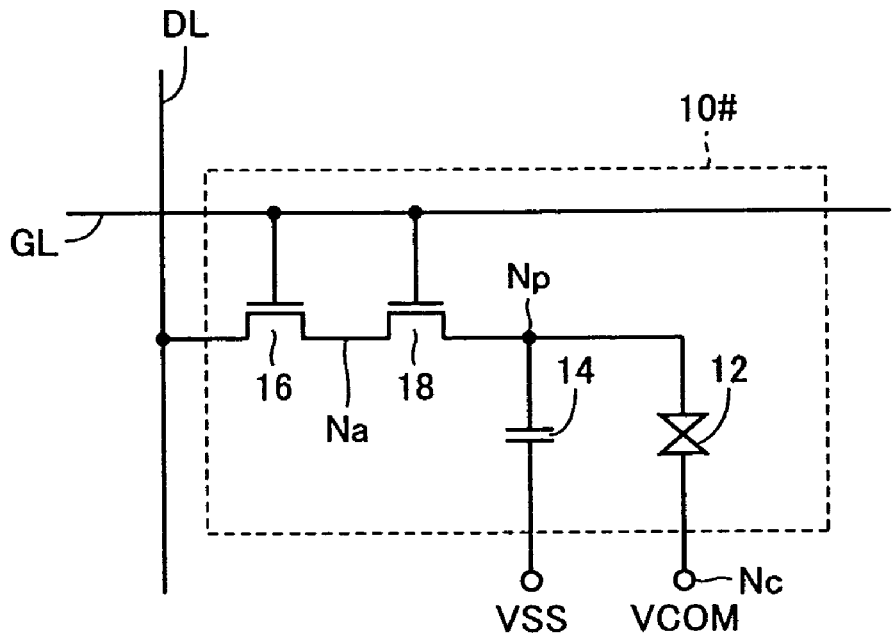
FIG. 2 is an equivalent circuit diagram showing a configuration example of a pixel shown as a first comparative example.

Pixel 10# shown in FIG. 2 may be used in place of pixel 10 in liquid crystal array portion 20 of liquid crystal display apparatus 5 shown in FIG. 1. Note that gate line GL# in liquid crystal array portion 20 is not necessary in the present case, since pixel 10# of the comparative example requires only one type of gate line GL.

Referring to FIG. 2, pixel 10# includes a liquid crystal element 12, a storage capacitor 14, N-type TFT elements 16, 18. Liquid crystal element 12 is connected between pixel electrode node Np and common electrode node Nc to provide a luminance corresponding to a voltage difference between pixel electrode node Np and common electrode node Nc. Common electrode node Nc is shared by a plurality of pixels in liquid crystal array portion 20 and supplied with a prescribed common voltage VCOM. Node Na corresponds to a connection node of N-type TFT elements 16 and 18.

In the following, it is assumed that smaller luminance is derived from larger voltage difference between pixel electrode node Np and common electrode node Nc. Specifically, a voltage difference between the voltage of pixel electrode node Np (display voltage) and common voltage VCOM becomes maximum at the minimum luminance (displaying in black), whereas the display voltage and common voltage VCOM are at the same level at the maximum luminance (displaying in white).

Storage capacitor 14 is provided to retain the voltage of pixel electrode node Np, and connected between pixel electrode node Np and a node supplying a prescribed voltage VSS. Prescribed voltage VSS is only required to be at a constant voltage level, and may be common voltage VCOM.

N-type TFT elements 16 and 18 are shown as representatives of gate insulating field-effect transistor, and generally formed on the same insulating substrate (a glass substrate, a resin substrate and the like) as the liquid crystal element 12. N-type TFT elements 16 and 18 are serially connected between corresponding data line DL and pixel electrode node Np, each gate being connected to corresponding gate line GL. In a scanning period where corresponding gate line GL is set to a select state (high level voltage), N-type TFT elements 16 and 18 turn on to connect corresponding data line DL and pixel electrode node Np. Thus, the display voltage is written in pixel electrode node Np from source drive circuit 40 via data line DL, and thus written display voltage is retained by storage capacitor 14.

In a non-scanning period where corresponding gate line GL is set to a non-select state (low level voltage), N-type TFT elements 16 and 18 turn off. As described above, since a plurality of TFT elements are serially connected between data line DL and pixel electrode node Np and thus source-drain voltage of each TFT element that turned off is reduced, an off-leakage current thereof is suppressed as well. The number of TFT elements may be one or more arbitrary numbers in accordance with the level of a leakage current.

Next, the operation of pixel 10# is described.

In order to avoid image persistence of liquid crystal elements, liquid crystal elements are generally AC-driven. For instance, common voltage VCOM is set to a constant DC voltage, and then a display voltage corresponding to the minimum luminance (displaying in black) is defined to switch between low voltage side or high voltage side relative to common voltage VCOM at a constant cycle.

Specifically, assuming that a voltage difference between pixel electrode node Np and common electrode node Nc required for displaying in black is VD, then the maximum and minimum values of the display voltage are expressed by VDHmax and VDLmin shown in expressions (1) and (2), respectively. Since a display voltage is transmitted through a data line, VDHmax and VDLmin also correspond to the maximum and minimum voltages of data line DL, respectively.

$$VDH\max = VCOM + VD \tag{1}$$

$$VDL\min = VCOM - VD \tag{2}$$

By subtracting (2) from (1), the following expression (3) can be derived:

$$VDH\max = VDL\min + 2 \cdot VD \tag{3}$$

A leakage current is more likely to flow when the voltage difference between pixel electrode node Np and data line DL is larger. In a non-scanning period (data retention period), for example, a leakage current is most likely to occur when pixel electrode node Np retains VDHmax as a display voltage while data line DL transmits VDLmin.

In order to suppress the leakage current, it is required to reduce the gate voltage of N-type TFT elements 16, 18 lower than the source voltage to turn-off these TFT elements more forcibly. Thus, considering the minimum voltage VDLmin of data line DL, gate line voltage VGL in a non-scanning period, i.e., in a non-select state must be set as in the following expression (4):

$$VGL = VDL\min - Vm \tag{4}$$

where Vm is a margin voltage for ensuring the turn-off of TFT elements.

The voltage of pixel electrode node Np retaining display voltage VDHmax can be determined to be VNpmax=VDLmin+2·VD from expression (3). Accordingly, the voltage between gate line GL and pixel electrode node Np, i.e., gate-drain voltage VGD of N-type TFT element 18 takes on the maximum value in the following expression (5):

$$VGD = VGL - VNp\max = VDL\min - Vm - (VDL\min + 2 \cdot VD) = -Vm - 2 \cdot VD \tag{5}$$

As general numerical values, assuming that Vm=2(V) and VD=5(V), then VGD=−12(V) can be determined from expression (5). This voltage difference is considerably large as compared to an operating voltage of internal circuitry of a liquid crystal display apparatus, which is generally 7–8 (V). This voltage difference is continuously applied to gate-source of N-type TFT element 18 in a non-scanning period.

Note that gate line voltage VGH in a scanning period, i.e., in a select state must be set in a range determined by the following expression (6) for transmitting the maximum voltage VDHmax of a data line:

$$VGH > VDH\max + Vth \tag{6}$$

where Vth is a threshold voltage of N-type TFT elements 16, 18.

Another known configuration of a conventional pixel configuration is to set common voltage VCOM of common electrode node Nc to be AC voltage for reducing power consumption by reducing a voltage amplitude of data line DL.

Figure 3:
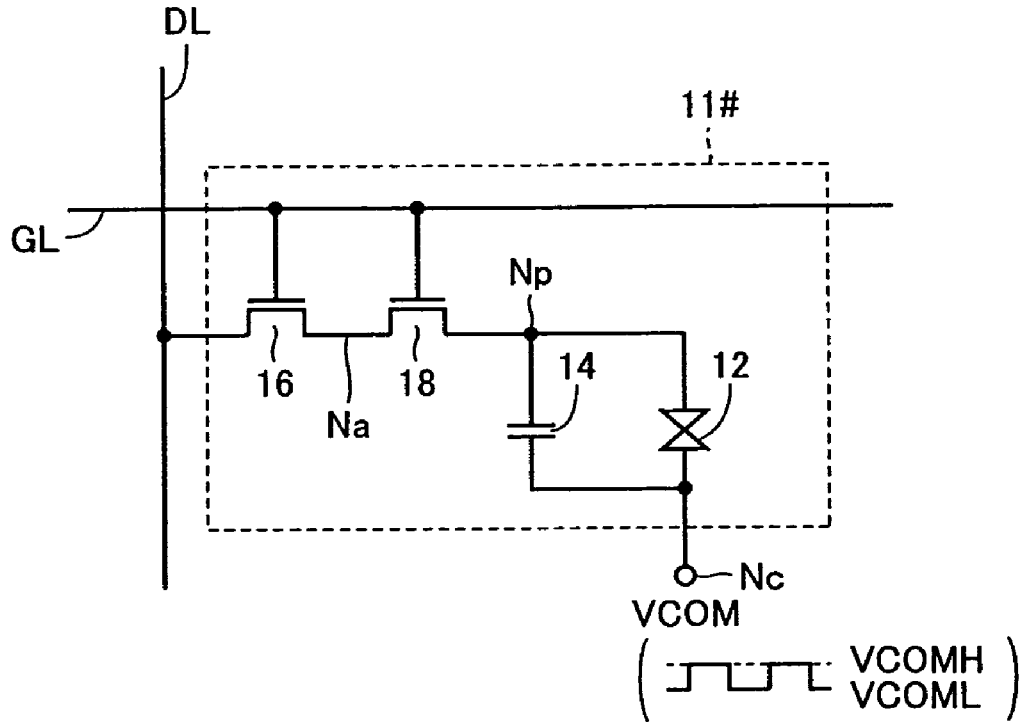
FIG. 3 is an equivalent circuit diagram showing a configuration example of a pixel shown as a second comparative example.

Referring to FIG. 3, pixel 11# shown as a second comparative example can be used in place of pixel 10 in liquid crystal array portion 20 in FIG. 1, similarly to pixel 10# shown in FIG. 2. Again, gate line GL# is not necessary in liquid crystal array portion 20 when pixel 11# is employed, since it requires only one type of gate line GL.

Referring to FIG. 3, pixel 11# is different from pixel 10# shown in FIG. 2 in that storage capacitor 14 is connected between pixel electrode node Np and common electrode node Nc. Further, common electrode node Nc is supplied with an AC voltage rather than a constant DC voltage, which is alternately set to low voltage VCOML and high voltage VCOMH in a prescribed cycle. The amplitude of this AC voltage corresponds to prescribed voltage VD described above. Specifically, it can be expressed as VCOMH−VCOML=VD.

In the pixel shown in FIG. 3, in a period in which common electrode node Nc is set to low voltage VCOML, the display voltage is set to VCOML+VD when providing the minimum luminance (displaying in black), while it is set to VCOML when providing the maximum luminance (displaying in white). In a period when common electrode node Nc is set to high voltage VCOMH, the display voltage is set to VCOMH−VD when providing the minimum luminance (displaying in black), while it is set to VCOMH when providing the maximum luminance (displaying in white).

Therefore, considering a data line voltage, maximum voltage VDHmax and minimum voltage VDLmin of a data line are determined by the following expressions (7) and (8):

$$VDH\max = VCOML + VD \tag{7}$$

$$VDL\min = VCOMH - VD \tag{8}$$

By subtracting (8) from (7), the following expression can be derived:

$$VDH\max = VDL\min + 2\cdot VD - (VCOMH - VCOML) = VDL\min + 2VD - VD = VDL\min + VD \tag{9}$$

Comparing expression (9) with (3), the maximum voltage of a data line in a liquid crystal display apparatus using pixel 11# of FIG. 3 can be made smaller by VD than in a liquid crystal display apparatus using pixel 10#. As a result, power consumption can be reduced.

Since common electrode node Nc is normally commonly connected to all liquid crystal elements, when the voltage of the common electrode node changes, the voltage of all common electrode nodes changes simultaneously. Therefore, in pixel electrode node Np that is in a data retention state (a non-scanning period) at this time, the voltage changes by the voltage change amount of common electrode node Nc (i.e., by VD).

As a result, the voltage of pixel electrode node retaining the display voltage of VDHmax can be expressed by the following expression (10);

$$VNp\max = VDH\max + VD \tag{10}$$

The voltage of pixel electrode node Np retaining the display voltage of VDLmin can be expressed by the following expression (11):

$$VNp\min = VDL\min - VD \tag{11}$$

According to equation (11), the source voltage of N-type TFT elements 16, 18 is reducing toward negative direction. It is the voltage change in the direction in which N-type TFT elements 16, 18 turn on. In order to avoid it, gate line voltage VGL in a non-select state must be lowered by the voltage change amount of common voltage VCOM.

Therefore, in a liquid crystal display apparatus with pixel 11#, gate line voltage VGL in a non-select state must be determined by the following expression (12) in order to suppress a leakage current:

$$VGL = VDL\min - Vm - VD \tag{12}$$

As a result, the maximum value of gate-drain voltage VGD of N-type TFT element 18 can be determined by the following expression (13):

$$VGD = VGL - VNp\max = VDL\min - Vm - VD - (VDH\max + VD) = VDL\min - VDH\max - 2\cdot VD - Vm \tag{13}$$

where, as general numerical values, VDHmax=5 (V), VD=5 (V), Vm=2 (V) and VDLmin=0(V), then VGD=−17 (V). Thus, further larger current as compared to pixel 10# in FIG. 2 is continuously applied on gate-drain of N-type TFT element 18 in a non-scanning period.

Note that gate line voltage VGH in a scanning period, i.e., in a select state is set based on expression (6) to transmit maximum voltage VDHmax on a data line.

As generally known, the on/off switching of a field-effect transistor such as a TFT element is controlled by applying a voltage on the gate that is separated from the channel region by an insulation film. If a dielectric breakdown occurs in the insulation film immediately below the gate, the gate and the channel region are short-circuited to pass a large current. Accordingly, the reliability of the gate insulation film must be considered adequately.

Since the voltage applied on the gate insulation film itself is smaller than gate line voltage VGH in a select state, the gate insulation film of TFT element is designed to withstand the voltage VGH applied during a scanning period. However, when a relatively large voltage stress is applied on a gate insulation film for a long period, even if it is in a withstand voltage range momentarily, it may accumulate to cause the dielectric breakdown of the gate insulation film. Such a phenomenon is known as time dependent dielectric breakdown (TDDB) of the gate insulation film.

Therefore, though the maximum value of the of TFT element 18 in pixel 10#, 11# in a data retention period (a non-scanning period) shown in expression (5) and (13) gate-drain voltage is below the withstand voltage of the gate insulation film, it is desirable to alleviate the voltage stress.

Configuration of Pixel According to First Embodiment

Next, a description is given on a configuration example of a pixel according to the first embodiment in which voltage stress of a TFT element during a data retention period is suppressed.

Figure 4:
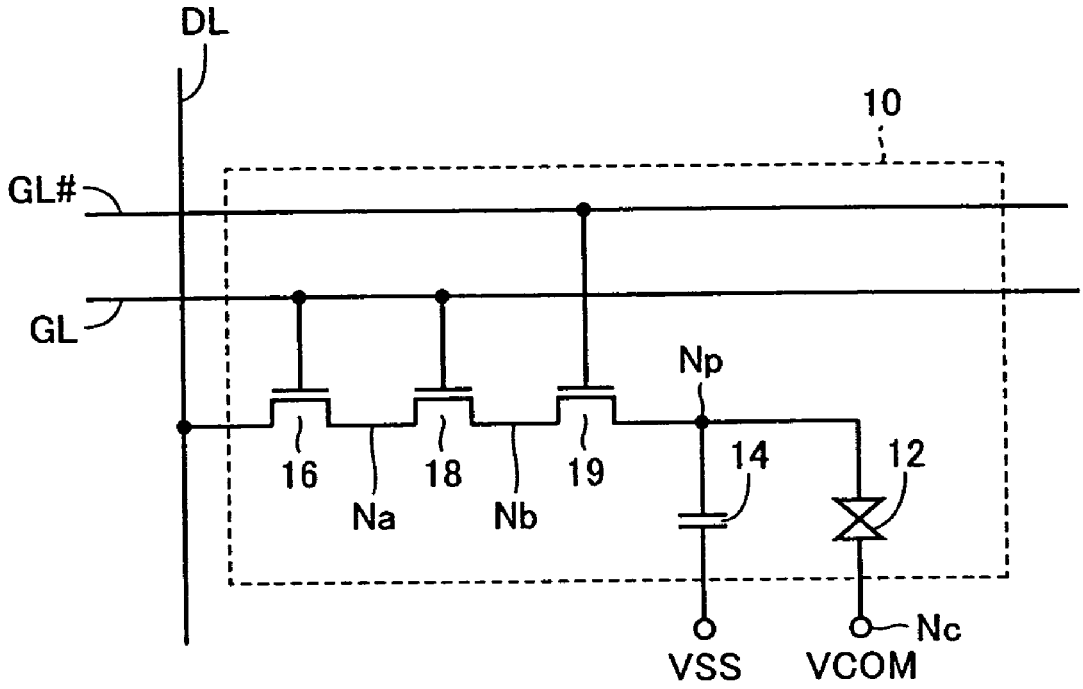
FIG. 4 is an equivalent circuit diagram showing a configuration example of a pixel according to a first embodiment of the present invention.

Referring to FIG. 4, pixel 10 according to the first embodiment shown in FIG. 1 is different from pixel 10# shown in FIG. 2 in that it further includes an N-type TFT element 19 connected between N-type TFT element 18 and pixel electrode node Np. The gate of N-type TFT element 19 is connected to gate line GL#. Node Nb corresponds to the connection node of N-type TFT elements 18 and 19.

As also shown in FIG. 1, in each pixel row, gate line GL connected to each gate of N-type TFT elements 16 and 18, and gate line GL# connected to the gate of N-type TFT element 19 are provided as independent interconnections. Further, common voltage VCOM of common electrode node Nc is provided as a constant DC voltage as in pixel 10# in FIG. 2.

Figure 5:
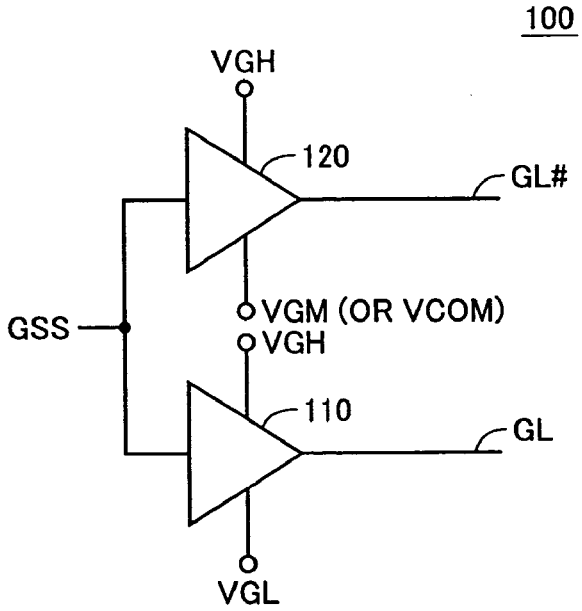
FIG. 5 is a conceptual illustration showing a configuration of a gate line voltage driving portion in a gate drive circuit shown in FIG. 1.

FIG. 5 is a conceptual illustration showing a configuration of a voltage control portion of gate lines GL, GL# in gate drive circuit 30 shown in FIG. 1. FIG. 5 representatively shows a configuration of gate drive unit 100 that is provided corresponding to each pixel row.

Referring to FIG. 5, gate drive unit 100 includes a gate line driver 110 that drives the voltage of gate line GL in response to a gate line select signal GSS, and a gate line driver 120 that drives the voltage of gate line GL# in response to gate line select signal GSS. Gate line select signal GSS is set to low level when a corresponding pixel row is selected for a scanning target, and to high level when it is not selected.

Gate line driver 110 drives gate line GL# to high voltage VGH to set to a select state when a corresponding pixel row is selected, while it drives gate line GL to low voltage VGL to set to a non-select state when corresponding pixel row is not selected.

Gate line driver 120 drives gate line GL# to high voltage VGH to set to a select state when a corresponding pixel row is selected, while it drives gate line GL# to intermediate voltage VGM to set to a non-select state when corresponding pixel row is not selected.

Figure 6:
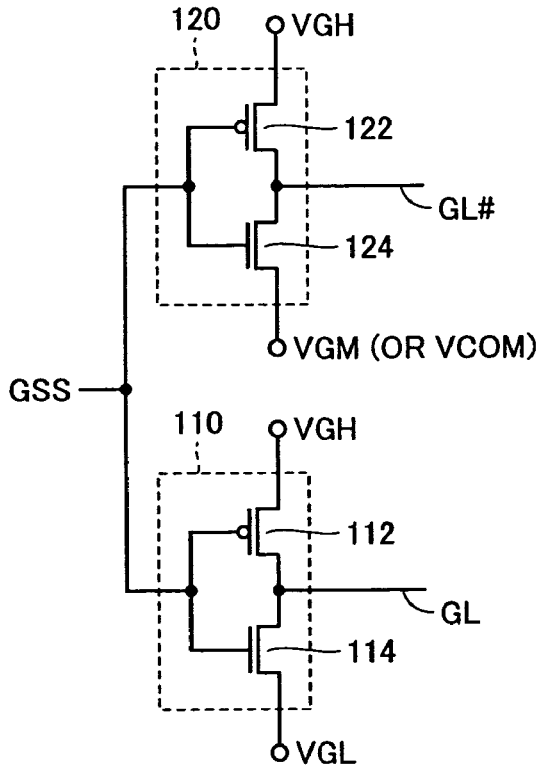
FIG. 6 is a circuit diagram showing a specific configuration example of a gate drive unit shown in FIG. 4.

Referring to FIG. 6, gate line driver 110 is formed with a CMOS inverter and includes a P-type TFT element 112 connected between a high voltage VGH supply node and corresponding gate line GL, and an N-type TFT element 114 connected between gate line GL and a low voltage VGL supply node. Each gate of TFT element 112 and 114 receives gate line select signal GSS.

Similarly, gate line driver 120 is formed with a CMOS inverter and includes a P-type TFT element 122 connected between a high voltage VGH supply node and corresponding gate line GL, and an N-type TFT element 124 connected between gate line GL# and an intermediate voltage VGM supply node. Each gate of TFT element 122 and 124 receives gate line select signal GSS, which is common to gate line driver 110.

Figure 9:
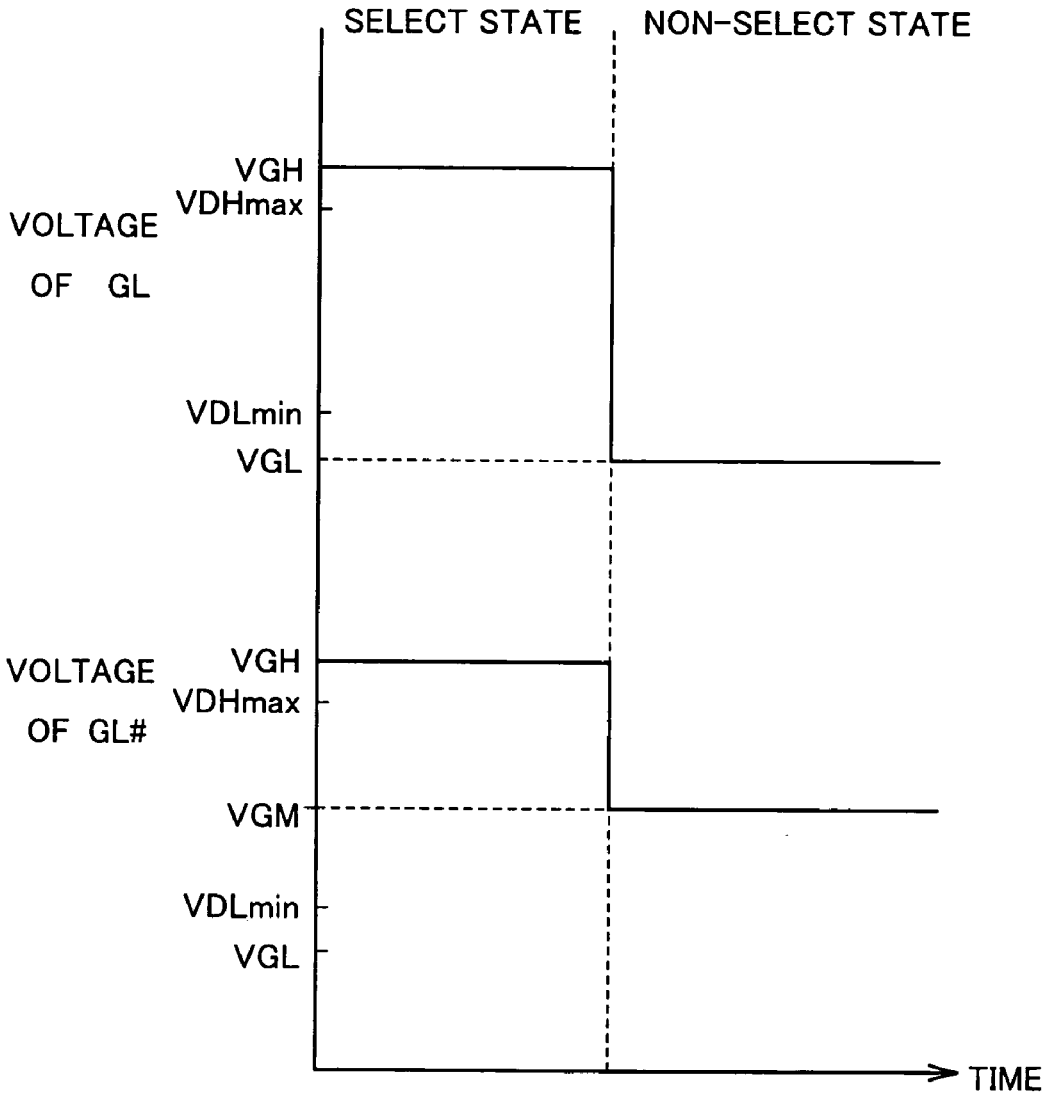
FIG. 9 is a voltage waveform diagram of gate lines according to a first embodiment of the present invention.

As above, in each pixel row, gate lines GL and GL# are set to high voltage VGH in a select state, which can fully turn-on N-type IFT elements 16, 18 and 19 according to expression (6) in pixel 10#, so that maximum voltage VDHmax on data line DL is transmitted to pixel electrode node Np, as shown in FIG. 9. FIG. 9 illustrates that the voltage setting of gate lines GL and GL# in the select and non-select states.

In a non-select state, gate line GL is set to low voltage VGL, whereas gate line GL# is set to intermediate voltage VGM between high voltage VGH and low voltage VGL (VGH>VGM>VGL), as shown in FIG. 9.

Referring back to FIG. 4, as for gate lines GL and GL# in a data retention period (a non-scanning period), i.e., in a non-select state, gate line GL is set to gate line voltage VGL as in expression (4) in pixel 10# in order to suppress a leakage current, whereas gate line GL# is set to an intermediate voltage VGM in order to suppress gate-drain voltage to TFT element 18.

As for N-type TFT element 19 connected to pixel electrode node Np, the maximum voltage stress is applied when the display voltage takes on a value of VDHmax or VDLmin. Therefore, in order to minimize the voltage stress to a gate insulation film for both of the display voltages, intermediate voltage VGM must be set to an intermediate level between maximum voltage VDHmax and minimum voltage VDLmin, i.e., between the maximum and the minimum values of the display voltages, preferably an average value of the two. Accordingly, it is preferred to set intermediate voltage VGM as in expression (14):

$$VGM=(VDH\max-VDL\min)/2+VDL\min=(VDH\max+VDL\min)/2=VCOM \quad (14)$$

Thus, when pixel electrode node Np retains display voltage VDHmax, gate-drain voltage VGD of N-type TFT element 19 in the data retention period will take on the maximum value in the following expression (15):

$$VGD=VGM-VNp\max=VCOM-(VCOM+VD)=-VD \quad (15)$$

Similarly, when pixel electrode node Np retains display voltage VDLmin, gate-drain voltage VGD of N-type TFT element 19 in a data retention period will take on the maximum value in the following expression (16):

$$VGD=VGM-VNp\min=VCOM-(VCOM-VD)=VD \quad (16)$$

Substituting the numerical values used in expression (5) into expressions (15) and (16), then |VGD|=5 (V) can be determined. Thus, the voltage stress to the gate insulation film of TFT element 19 that is continuously applied with voltage in a non-scanning period is alleviated, compared to N-type TFT element 18 in pixel 10#, which yields |VGD|=12 (V) under the same condition.

Further, by providing such N-type TFT element 19, the voltage difference between the drain of N-type TFT element 18, namely node Nb, and data line DL will be smaller than between data line DL and pixel electrode node Np. As a result, source-drain voltage applied on N-type TFT elements 16 and 18 during a non-scanning period becomes smaller than in pixel 10# in FIG. 2. Additionally, in pixel 10, since gate line GL in a non-select state is set to low voltage VGL as in pixel 10# in FIG. 2, as compared to pixel 10# of the comparative example, the leakage current between pixel electrode node Np and data line DL during a data retention period can rather be suppressed, and the voltage stress to a gate insulation film of N-type TFT element 18 can rather be alleviated to increase its operating reliability.

As described above, according to the configuration of pixel 10 of the first embodiment, a leakage current is further suppressed while alleviating a voltage stress on a gate insulation film of a TFT element during a data retention period, as compared to pixel 10# shown in FIG. 2.

As a result, display voltage retentivity in each pixel may be improved, and thus, a scanning cycle can be made longer to reduce the power consumption, variations in luminance can be suppressed to improve the display quality, and the operating reliability of a TFT element can be improved.

Though in FIG. 4, the configuration example where two N-type TFT elements 16, 18 having their gates connected to gate line GL and one N-type TFT element 19 having its gate connected to gate line GL# are connected in series between data line DL and pixel electrode node Np, the number of these TFT elements may be one or more arbitrary numbers, considering allowable leakage current and circuit area.

Second Embodiment

Figure 7:
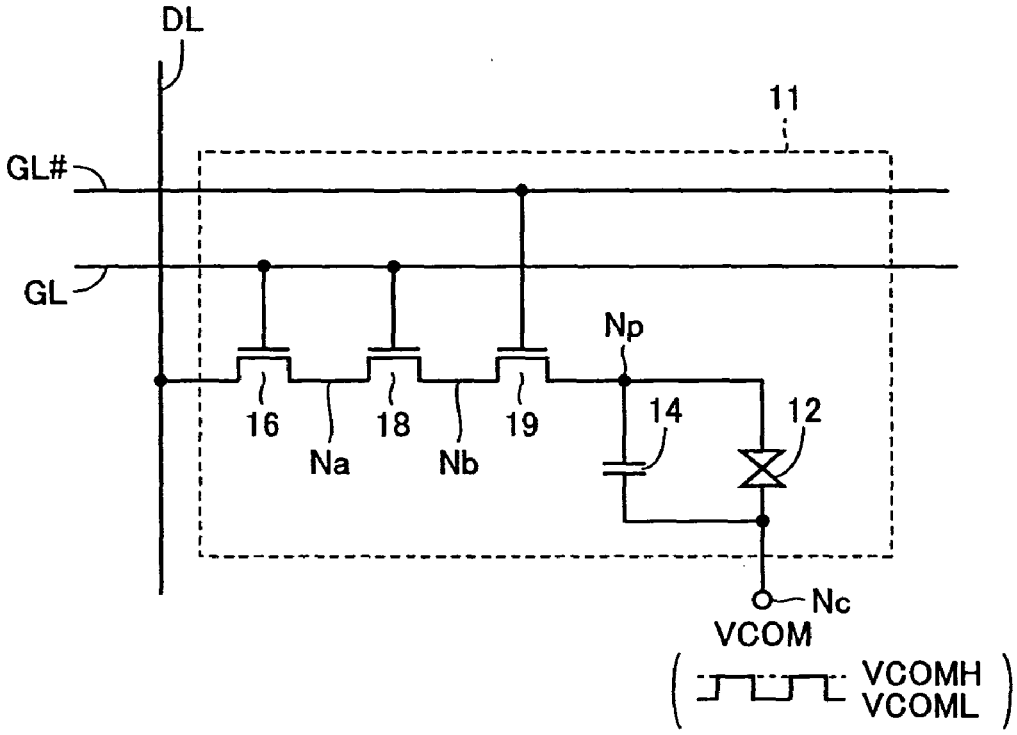
FIG. 7 is an equivalent circuit diagram showing a configuration example of a pixel according to a second embodiment of the present invention.

FIG. 7 is an equivalent circuit diagram showing a configuration example of a pixel according to a second embodiment.

A pixel 11 shown in FIG. 7 can be employed in place of pixel 10 in the overall configuration diagram of FIG. 1.

Referring to FIG. 7, pixel 11 according to the second embodiment is different from pixel 10 according to the first embodiment shown in FIG. 6 in that storage capacitor 14 is connected between pixel electrode node Np and a common electrode node Nc. Further, common voltage VCOM of common electrode node Nc is supplied as AC voltage with amplitude VD that is set alternately to low voltage VCOML and high voltage VCOMH in a constant cycle, as in pixel 11# in FIG. 3. Specifically, pixel 11 includes N-type TFT element 19 additionally to the components of pixel 11# of the comparative example shown in FIG. 3.

Similarly to pixel 10 shown in FIG. 4, each gate of N-type TFT elements 16, 18 is connected to gate line GL, while the gate of N-type TFT element 19 is connected to another gate line GL#. The voltage of gate lines GL, GL# is controlled as in the configuration shown in FIGS. 5 and 6 in the first embodiment, thus detailed description thereof is not repeated.

Note that in pixel 11, the voltage of pixel electrode node Np retaining VDHmax as the display voltage changes to "VDHmax +VD" in response to common voltage VCOM changing by VD. On the other hand, the voltage of pixel electrode node Np retaining VDLmin changes to VDLmin−VD in response to the change of common voltage VCOM. Therefore, in the configuration according to the second embodiment, intermediate voltage VGM corresponding to the voltage of gate line GL# in a non-select state is preferably set as in the following expression (17) to have the average voltage of these voltages:

$$VGM=[(VDH\max+VD)+(VDL\min-VD)]/2=(VDH\max+VDL\min)/2=(VCOMH+VCOML)/2 \quad (17)$$

Thus, when pixel electrode node Np retains display voltage VDHmax, gate-drain voltage VGD of N-type TFT element 19 in a data retention period will take on a maximum value in the following expression (18):

$$VGD=VGM-VNp\max=(VCOMH+VCOML)/2-(VDH\max+VD)=(VCOMH+VCOML)/2-(VCOML+2-VD)=(VCOMH-VCOML)/2-2\cdot VD=-1.5\cdot VD \quad (18)$$

Similarly, when pixel electrode node Np retains display voltage VDLmin, gate-drain voltage VGD of N-type TFT element 19 in a data retention period will take on a maximum value in the following expression (19):

$$VGD=VGM-VNp\min=(VCOMH+VCOML)/2-(VDL\min-VD)=(VCOMH+VCOML)/2-(VCOMH-2\cdot VD)=-(VCOMH-VCOML)/2+2\cdot VD=1.5\cdot VD \quad (19)$$

Substituting the numerical values used in expression (5) into expressions (18) and (19), then |VGD|=7.5 (V) can be determined. Thus, the voltage stress to the gate insulation film of TFT element 19 that is continuously applied with voltage in a non-scanning period is alleviated, compared to N-type TFT element 18 in element 11#, which yields |VGD|=17 (V) under the same condition.

Further, by providing such N-type TFT element 19 similarly to pixel 10 according to the first embodiment, the voltage difference between the drain of N-type TFT element 18, namely node Nb, and data line DL will be smaller than between data line DL and pixel electrode node Np. Accordingly, as compared to pixel 11#, in pixel 11, the leakage current between pixel electrode node Np and data line DL during data retention period can rather be suppressed, and the voltage stress to a gate insulation film of N-type TFT element 18 can rather be alleviated to increase its operating reliability.

As described above, according to the configuration of the second embodiment, similarly to pixel 11# shown in FIG. 3, the power consumption is reduced by suppressing data line voltage amplitude, while a leakage current is suppressed and the voltage stress on a gate insulation film of a TFT element during a data retention period is alleviated.

As a result, display voltage retentivity in each pixel may be improved similarly to the configuration according to the first embodiment, and thus, a scanning cycle can be made longer to reduce the power consumption, variations in luminance can be suppressed to improve the display quality, and the operating reliability of a TFT element can be improved.

Note that, in a pixel according to the second embodiment shown in FIG. 7 also, the number of the TFT element having its gate connected to gate line GL and the TFT element having its gate connected to gate line GL# may be one or more arbitrary numbers.

Figure 10:
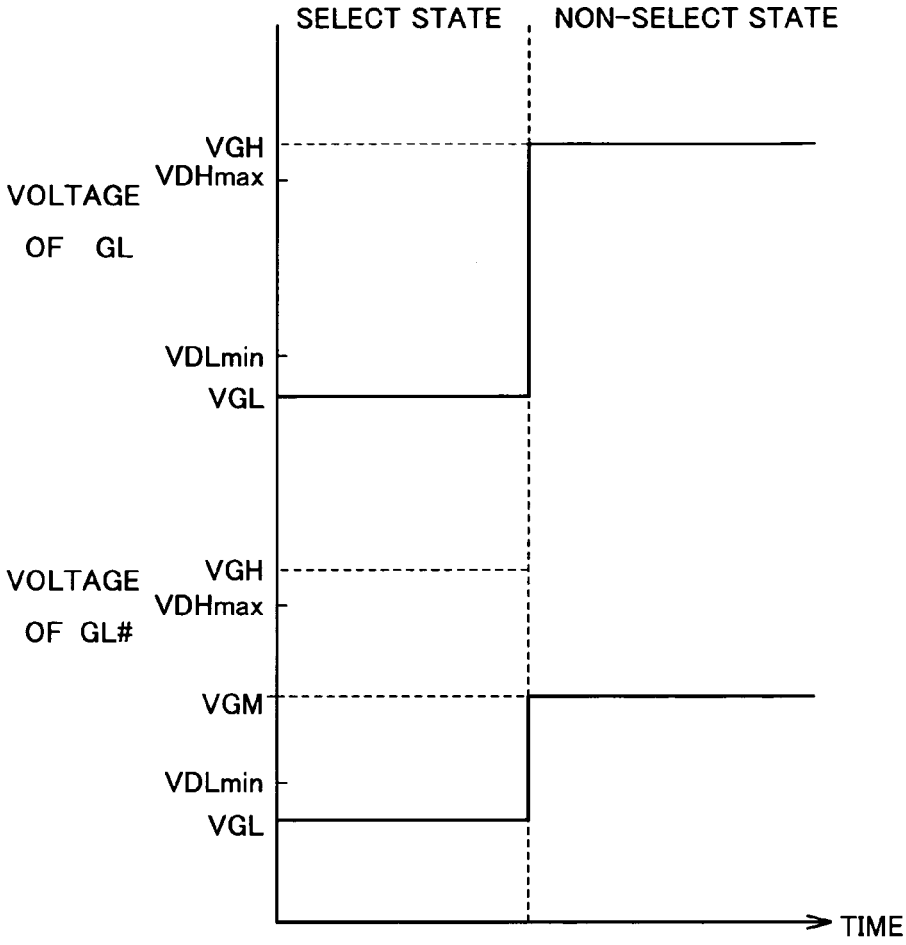
FIG. 10 is a voltage waveform diagram of gate lines according to first and second embodiments of the present invention.

Further, though the configuration example using N-type TFT elements 16, 18 and 19 are illustrated in FIGS. 4 and 7, one or all of these TFT elements can be replaced by P-type TFT element(s) to form a pixel according to the first and second embodiments. In this case, the polarity of voltage setting of gate lines GL, GL# connected to the gate(s) of P-type TFT element(s) may be inverted. Specifically, low voltage VGL and high voltage VGH should be set to the voltages that can fully turn on/off the P-type TFT element(s) considering the transistor characteristics. Then, gate line GL should be driven to low voltage VGL in a select state and to high voltage VGH in a non-select state, while gate line GL# should be driven to low voltage VGL in a select state and to intermediate voltage VGM in a non-select state, as shown in FIG. 10. FIG. 10 illustrates the voltage setting of gate lines GL and GL# in the select and non-select states when the P-type TFT elements are used.

Third Embodiment

In the first and second embodiments, the configuration of a pixel is described in which a TFT element, of which gate voltage is set to intermediate voltage VGM in a non-select state, is provided in a leakage current path, to achieve both of leakage current suppression and protection of a gate insulation film of TFT element.

Though such a configuration is desirable for protecting a TFT element in a normal operation, it can not provide a desired stress to a TFT element in an acceleration test for screening defects in which a larger stress than in a normal operation is intentionally applied on the TFT element (a burn-in test). In the burn-in test, since the operation is tested under more severe condition than in a normal operation, i.e., in high temperatures and by applying a large voltage stress for a prescribed period, it is desirable to have a configuration that can provide sufficient voltage stress in a short time in order to perform the test effectively.

In a third embodiment, a description will be given on a configuration of a gate line driver that can switch the driving voltage in order to provide sufficient voltage stress in the burn-in test.

Figure 8:
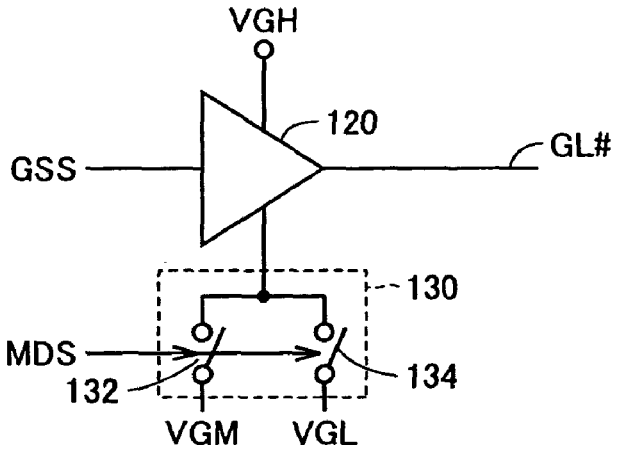
FIG. 8 is a circuit diagram illustrating a configuration of a gate line driver according to a third embodiment of the present invention.

FIG. 8 is a circuit diagram showing a configuration of a gate line driver according to the third embodiment.

Referring to FIG. 8, in the configuration according to the third embodiment, a switch circuit 130 is provided to a gate line driver 120 for gate line GL# shown in FIG. 5. Switch circuit 130 includes switches 132 and 134 that operate in response to a mode select signal MDS. In a normal operation mode, switch 132 turns on to provide intermediate voltage VGM to gate line driver 120, and switch 134 turns off. In a test mode where the burn-in test is performed, switch 134 turns on to provide low voltage VGL to gate line driver 120 and switch 132 turns off.

Figure 11:
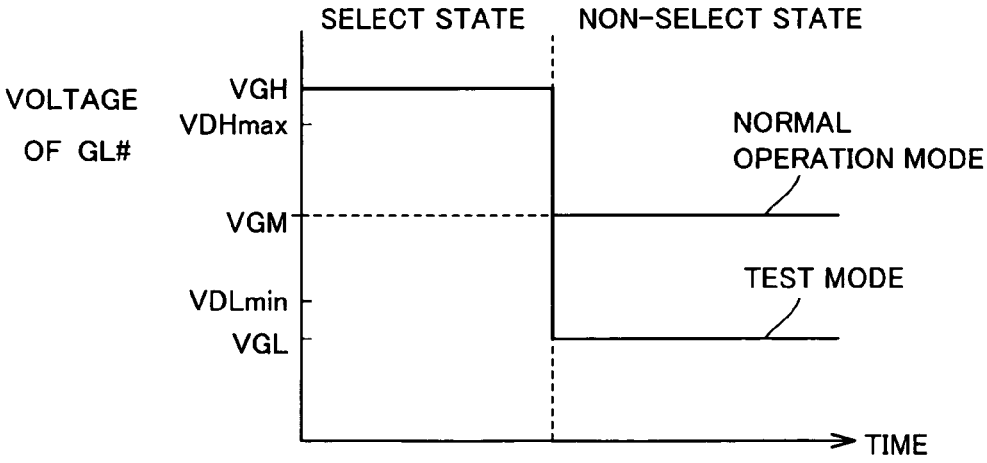
FIG. 11 is a voltage waveform diagram of a gate line according to a third embodiment of the present invention.

By employing such a configuration, gate line driver 120 in a normal operation mode drives gate line GL# in a select state to high voltage VGH and drives gate line GL# in a non-select state to an intermediate voltage VGM, in response to a gate line select signal GSS. In a test mode, gate driver 120 drives gate line GL# in a select state to high voltage VGH and drives gate line GL# in a non-select state to low voltage VGL, similarly to gate line GL, in response to gate line select signal GSS, as shown in FIG. 11. FIG. 11 illustrates the voltage setting of gate line GL#.

As a result, for gate line GL# that is connected to the gate of N-type TFT element 19, the voltage difference between a select state and a non-select state in a test mode (VGH−

VGL) becomes larger than the voltage difference between a select state and a non-select state in a normal mode (VGH–VGM).

The configuration of the third embodiment is similar to that of the first or second embodiment except that switch circuit 130 is provided to gate line driver 120 for gate line GL#, thus its detailed description is not repeated.

By employing such a configuration, in the configuration according to the third embodiment, the effect described in the first and second embodiment is achieved in a normal operation mode, while the burn-in test is effectively performed in a test mode, applying sufficient voltage stress to N-type TFT element 19 in a short time.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A liquid crystal display apparatus comprising:

a plurality of pixels arranged in rows and columns, each for providing luminance corresponding to a display voltage;

a plurality of first gate lines provided corresponding to respective said rows of said plurality of pixels;

a plurality of second gate lines provided corresponding to respective said rows of said plurality of pixels;

a plurality of data lines provided corresponding to respective said columns of said plurality of pixels;

a gate drive circuit for driving each of said plurality of first and second gate lines to a voltage that is different between a select state in which corresponding one of said rows is selected for a scanning target in accordance with a prescribed scanning cycle and a non-select state except for said select state; and a source drive circuit for driving said plurality of data lines to said display voltage that corresponds to the pixels included in the row selected for said scanning target;

said plurality of pixels each including a liquid crystal element having a pixel electrode and a common electrode for providing luminance that corresponds to a voltage difference between said pixel electrode and said common electrode, a first field-effect transistor electrically connected between corresponding one of said data lines and a first node, and having its gate electrically connected to corresponding one of said first gate lines, and a second field-effect transistor electrically connected between said first node and said pixel electrode, and having its gate electrically connected to corresponding one of said second gate lines;

said gate drive circuit setting each voltage of said first and second gate lines in said select state to a first voltage that can turn-on each of said first and second field-effect transistors, while setting a voltage of said first gate line in said non-select state to a second voltage that can turn-off said first field-effect transistor as well as setting a voltage of said second gate line in said non-select state to a third voltage that is intermediate between a maximum value and a minimum value of said display voltage, wherein said third voltage is substantially at the same level throughout successive non-select states.

2. The liquid crystal display apparatus according to claim 1, said common electrode being supplied with a prescribed DC voltage, and said third voltage being substantially at a same level as said prescribed DC voltage.

3. The liquid crystal display apparatus according to claim 1, said common electrode being supplied with an AC voltage that is set to one of fourth and fifth voltages in a constant cycle, and said third voltage being substantially at a same level as an average of said fourth and fifth voltage.

4. The liquid crystal display apparatus according to claim 1, said gate drive circuit including a plurality of drive units provided corresponding to said rows, respectively;

said plurality of drive units each including a first driver for driving corresponding one of said first gate lines with one of said first and second voltages in response to a select signal that indicates whether said corresponding one of said rows is selected for said scanning target, and a second driver for driving corresponding one of said second gate lines with one of said first and third voltages in response to said select signal.

5. The liquid crystal display apparatus according to claim 1, said gate drive circuit setting said second gate line in the non-select state to said third voltage in a normal mode, and setting to a sixth voltage in a test mode, and a difference between said first and sixth voltages being larger than a difference between said first and third voltages.

6. The liquid crystal display apparatus according to claim 5, said sixth voltage being substantially at a same level as said second voltage.

7. The liquid crystal display apparatus according to claim 1, said first and second field-effect transistors being formed with an N-type thin film transistor, and said first voltage being higherthan said second voltage.

8. The liquid crystal display apparatus according to claim 1, said first and second field-effect transistors being formed with a P-type thin film transistor, and said first voltage being lower than said second voltage.

9. A liquid crystal display apparatus comprising:

a pixel for providing luminance corresponding to a display voltage; and a data line for transmitting said display voltage supplied to said pixel;

said pixel including a liquid crystal display element having a pixel electrode and a common electrode for providing luminance corresponding to a voltage difference between said pixel electrode and said common electrode, a first field-effect transistor electrically connected between said data line and a first node, and a second field-effect transistor electrically connected between said first node and said pixel electrode;

the liquid crystal display apparatus further comprising a gate drive circuit for driving each gate voltage of said first and second field-effect transistors to a voltage that is different between a select state in which said pixel is selected for a scanning target in accordance with a prescribed scanning cycle and a non-select state except for said select state;

said gate drive circuit in said select state setting each said gate voltage to a first voltage that can turn-on each of said first and second field-effect transistors, while setting a gate voltage of said first field-effect transistor in said non-select state to a second voltage that can turn-off said first field-effect transistor as well as setting a voltage of said second field-effect transistor in said non-select state to a third voltage that is intermediate between a maximum value and a minimum value of said display voltage, wherein said third voltage is substantially at the same level throughout successive non-select states.

* * * * *